United States Patent [19]

Lowe

[11] 4,106,245

[45] Aug. 15, 1978

[54] FRAMELESS METAL BUILDING

[76] Inventor: Colin F. Lowe, P.O. Box 128, Hutsonville, Ill. 62433

[21] Appl. No.: 831,781

[22] Filed: Sep. 9, 1977

[51] Int. Cl.[2] ..... E04B 7/02

[52] U.S. Cl. ..... 52/90; 52/278; 52/282; 52/537

[58] Field of Search ..... 52/90, 276, 277, 278, 52/282, 537, 521, 588, 621

[56] References Cited

U.S. PATENT DOCUMENTS

| | | | |
|---|---|---|---|
| 1,447,966 | 3/1923 | Davidson | 52/278 X |
| 1,840,041 | 1/1932 | Kellogg | 52/90 |
| 2,175,653 | 10/1939 | Williams | 52/278 X |
| 2,439,095 | 4/1948 | Mitchell | 52/278 X |
| 2,480,699 | 8/1949 | Black | 52/276 |
| 2,742,114 | 4/1956 | Behlen | 52/630 X |
| 3,203,145 | 8/1965 | Raynes | 52/90 X |
| 3,308,596 | 3/1967 | Cooper et al. | 52/630 |
| 3,492,765 | 2/1970 | Behlen | 52/630 X |
| 3,500,596 | 3/1970 | Anderson | 52/79.7 |

FOREIGN PATENT DOCUMENTS

| | | | |
|---|---|---|---|
| 214,576 | 7/1956 | Australia | 52/90 |
| 467,209 | 10/1928 | Fed. Rep. of Germany | 52/537 |
| 216,083 | 10/1967 | Sweden | 52/90 |
| 976,927 | 12/1964 | United Kingdom | 52/277 |

*Primary Examiner*—Alfred C. Perham
*Attorney, Agent, or Firm*—Jacox & Meckstroth

[57] ABSTRACT

A series of rectangular roof panels and rectangular wall panels each include inner and outer corrugated sheet metal skins which are rigidly secured by fasteners to opposite sides of formed sheet metal longitudinally extending spacer members rigidly connected by formed sheet metal laterally extending spacer members. A formed sheet metal box-type ridge beam and a series of fasteners rigidly connect the inner skins and spacer members of the roof panels on opposite sides of the ridge to transmit tension forces, and a compressive wedge and fasteners rigidly connect the outer skins and spacer members of the roof panels for transmitting compression forces. Inclined inner attachment plates and fasteners rigidly connect the inner skins and spacer members of the roof panels to the inner skins and spacer members of the wall panels, and outer attachment plates and fasteners rigidly connect the spacer members of the roof panels to the outer skins and spacer members of the wall panels to form a building structure which has substantial total strength and can be easily and quickly erected without the use of a crane.

22 Claims, 8 Drawing Figures

FRAMELESS METAL BUILDING

BACKGROUND OF THE INVENTION

In the art of metal buildings, it is common to use a steel frame which provides for a low roof pitch and for resisting the loads on the building. Parallel spaced roof purlins and parallel spaced wall girts are secured to the frame, and corrugated sheet metal skins or panels are attached to the outer surfaces of the roof purlins and wall girts to form the outer covering or shell for the building. Usually the outer metal skin or sheet metal panels are corrugated in order for the panels to span the spaces between adjacent roof purlins and wall girts, but the frame supports substantially the entire static, wind and snow loads on the metal building.

There have been attempts to construct metal buildings without a metal frame, purlins and girts and to use the inherent strength of corrugated roof and wall panels to withstand the various loads on the building. Examples of such building constructions are disclosed in U.S. Pat. No. 2,742,114 and No. 3,492,765. It has also been proposed to construct a metal building without the use of purlins and girts by erecting a frame and attaching to the frame heavy corrugated sheet metal panels, for example, as disclosed in U.S. Pat. No. 3,308,596. The construction of a metal building has also been proposed from prefabricated roof and wall panels each of which includes inner and outer corrugated sheet metal skins tied together by parallel spaced bars and with an insulation material confined between the inner and outer skins, for example, as disclosed in U.S. Pat. No. 3,500,596.

SUMMARY OF THE INVENTION

The present invention is directed to an improved sheet metal building structure formed of prefabricated sheet metal panels constructed and assembled in a manner which provides for substantially high total strength and thus high resistance to wind and snow loads, and which eliminates the need for a metal frame, roof purlins and wall girts. In addition, the metal building of the present invention significantly reduces the total time and cost for constructing and erecting a metal building and, in addition, eliminates the need for a crane to erect the building. The construction of the prefabricated sheet metal panels and the manner by which the panels are coupled together further provides for fast, simple and accurate erection of a metal building and utilizes the inherent strength of the sheet metal inner and outer skins of the panels to support or carry substantially the entire loads which are applied to the building as a result of various weather conditions.

Other features and advantages of the invention will be apparent from the following description, the accompanying drawings and the appended claims.

DESCRIPTION OF THE PREFERRED EMBODIMENT

Figure 1:
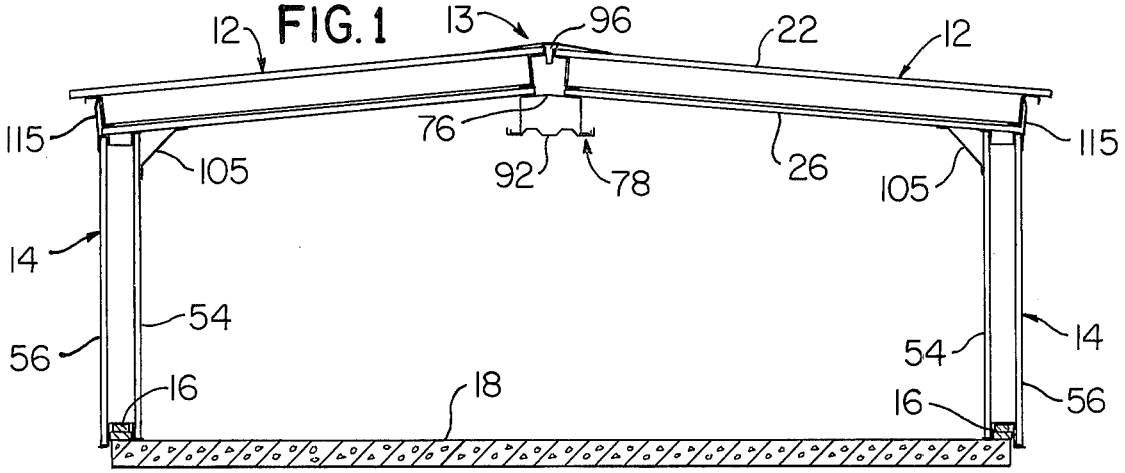
FIG. 1 is an end elevational view of a sheet metal building constructed in accordance with the invention and with the end walls removed.

A metal building constructed in accordance with the invention has an end view as generally illustrated in FIG. 1 and includes a plurality of prefabricated rectangular roof panels 12 which are coupled together along the center ridge 13 of the building and which are coupled together and supported by a plurality of prefabricated rectangular side wall panels 14 and end wall panels (not shown). The vertical side and end wall panels seat upon base floor plates 16 which are bolted to the outer edges of a concrete slab floor 18.

Figure 2:
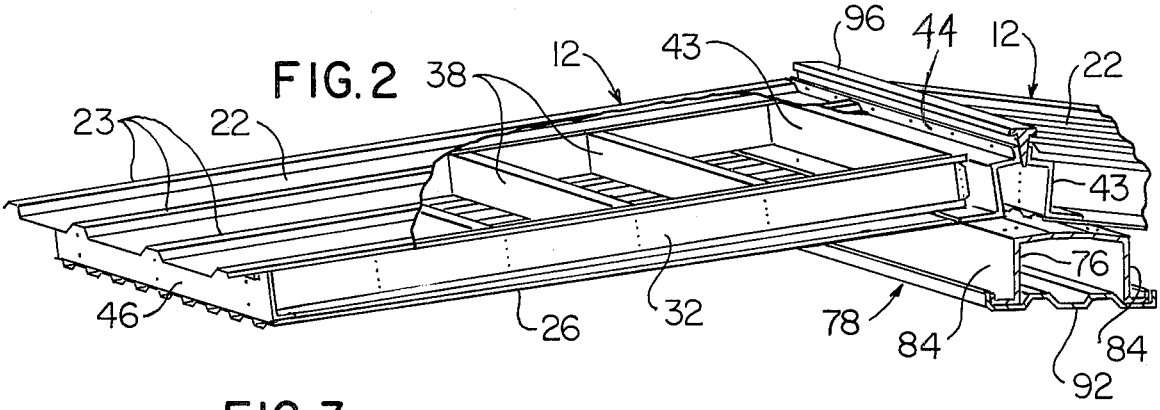
FIG. 2 is a fragmentary perspective view of two opposing roof panels used in the building shown in FIG. 1 and illustrating the system for coupling the roof panels along the ridge of the building.
Figure 7:
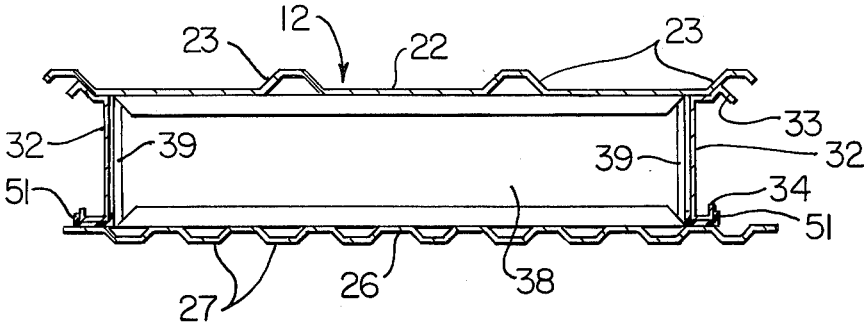
FIG. 7 is an enlarged cross-section of a typical roof panel shown in FIG. 2.

Each of the prefabricated roof panels 12 is constructed of formed sheet metal and includes an upper or outer sheet metal skin 22 (FIGS. 2 and 7) having parallel spaced roll-formed ribs 23. Each roof panel 12 also includes a lower or inner sheet metal skin 26 (FIG. 7) which forms an inner liner for the building and also has parallel spaced ribs 27 to provide a corrugated cross-sectional configuration. As illustrated in FIG. 1, the thicknesses of the roof panels 12 and the wall panels 14 are somewhat exaggerated relative to the size of the metal building.

The roll-formed sheet metal skins 22 and 26 of each roof panel 12 are rigidly secured by blind rivets (not shown) such as "Pop" rivets to parallel spaced longitudinally extending spacer members 32 (FIG.7) which are formed of sheet metal and have generally a channel-shaped configuration. The upper flange of each spacer member 32 has a V-shaped rib portion 33 which is secured by rivets to an adjacent rib 23 of the overlying outer skin 22, and the lower flange of each spacer member 32 has an inwardly projecting return rib portion 34 and is secured by rivets to the inner sheet metal skin 26.

Figure 4:
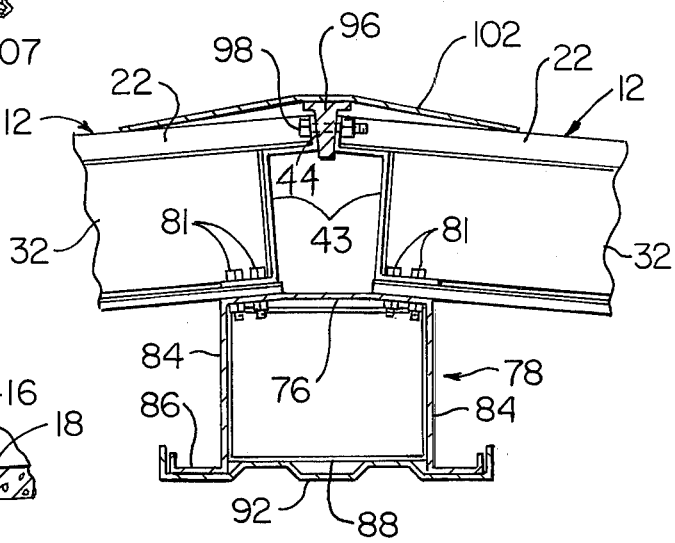
FIG. 4 is an enlarged vertical section through the ridge portion of the building shown in FIG. 1.

The longitudinally extending spacer member 32 of each roof panel 12 are rigidly connected by laterally extending spacer members 28 (FIGS. 2 and 7) each of which is also formed of sheet metal and has opposite end flanges 39 (FIG. 7) secured by rivets to the spacer members 32. The upper and lower flanges of each laterally extending spacer member 38 has inwardly projecting rib portions 41. The upper or inner ends of the longitudinally extending spacer members 32 of each roof panel 12 are also rigidly secured by a ridge spacer member 43 (FIG. 4) which has generally a Z-shaped cross-sectional configuration with an upwardly projecting flange 44. The outer or lower ends of the longitudinally extending spacer members 32 of each roof panel 12 are rigidly connected by an eve spacer member 46 (FIG. 5) which also has a Z-shaped cross-sectional configuration and includes a downwardly projecting return lip portion 47. All of the spacer members 32, 38, 43 and 46 of each roof panel 12 are formed of sheet metal and are rigidly secured by rivets to the upper or outer skin 22 and lower or inner skin 26 to form, in effect, a box beam.

A channel shaped strip 51 (FIGS. 5 and 7) of thermal insulation material is sandwiched between the lower surfaces of each of the spacer members and the inner skin 26 to avoid any significant heat transfer between the inner skin 26 and the outer skin 22.

Figure 3:
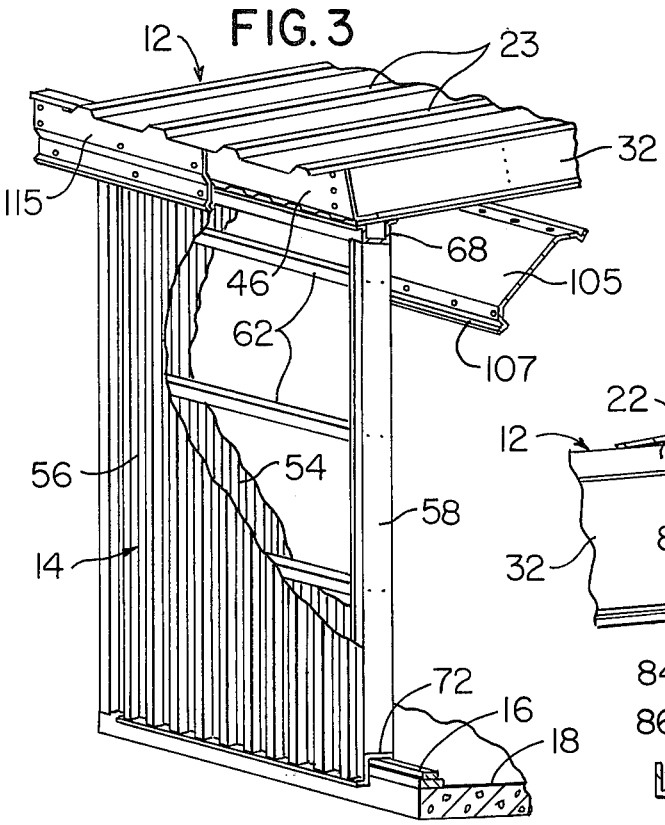
FIG. 3 is a fragmentary perspective view of the wall and roof panels used in the building shown in FIG. 1 and illustrating the coupling of the roof panels to the wall panels.
Figure 8:
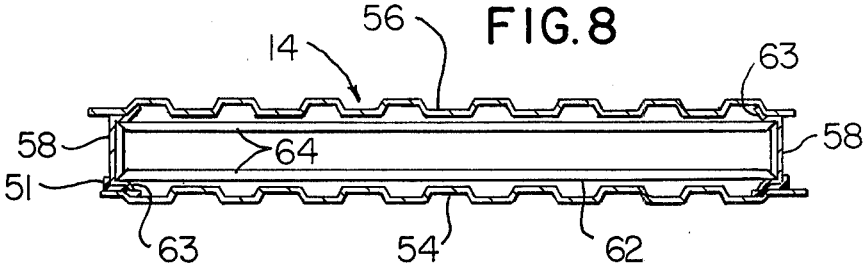
FIG. 8 is an enlarged cross-section of a typical wall panel as shown in FIG. 3.

Each of the side wall panels 14 is constructed or fabricated substantially the same as the roof panels 12. Thus referring to FIGS. 3 and 8, a rectangular wall panel 14 includes a corrugated or ribbed inner sheet metal skin 54 and a ribbed sheet metal outer skin 56 which are secured by rivets to a set of vertical or longitudinally extending sheet metal spacer members 58. The spacer members 58 are rigidly connected by horizontal or laterally extending sheet metal spacer members 62. As shown in FIG. 8, each of the longitudinally extending spacer members 58 has generally a channel-shaped configuration with outwardly projecting lip portions 63 which are riveted to the roll-formed inner and outer skins. Each of the laterally extending spacer members 62 is constructed similar to the spacer members 38 and has inwardly projecting return lip portions 64. The spacer members 62 also have end flanges 66 which are secured by rivets to the parallel spaced longitudinally extending spacer members 58 of the wall panel.

Figure 5:
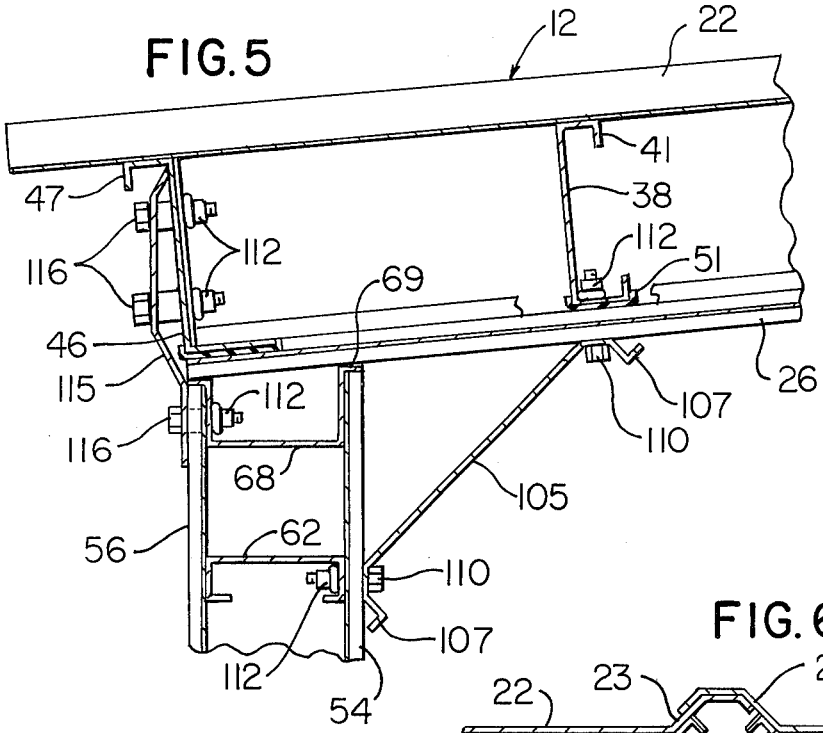
FIG. 5 is an enlarged vertical section through an eve portion of the building shown in FIG. 1.

Referring to FIG. 5, the upper ends of the inner and outer skins of the wall panels 14 forming each side wall are rigidly connected by a channel-shaped horizontal spacer member 68 which has outwardly projecting lip portions 69 overlying the upper ends of the inner and outer skins 54 and 56. The top spacer member 68 is formed in sections and extends continuously the full length of the building and cooperates to align the wall panels. A similarly shaped channel-like spacer member 72 (FIG. 3) rigidly secures the lower end portions of the inner and outer skins of each wall panel 14 and receives the plate member 16 secured to the floor 18. While not shown, the end wall panels for the metal building are constructed substantially the same as the side wall panels 14, except that the end wall panels have a greater length or height and have upper ends which conform to the pitch of the building roof. One or both of the end walls may be provided with a large door opening according to the ultimate use of the metal building.

Figure 6:
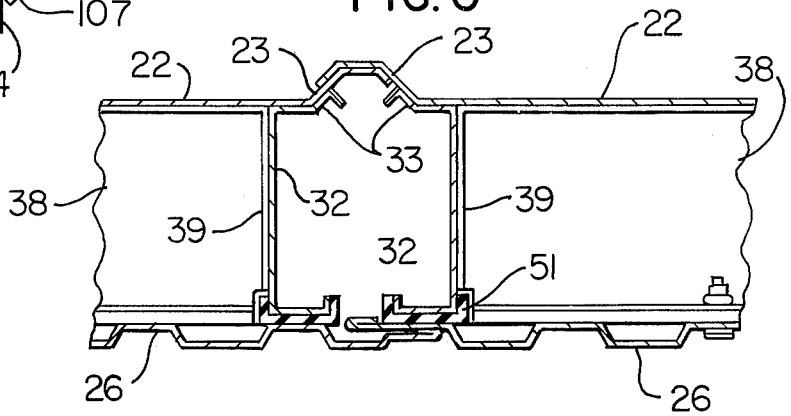
FIG. 6 is an enlarged fragmentary section showing the assembled relation of two adjacent roof panels.

In the erection of a metal building in accordance with the invention, two or more side wall panels 14 are placed upon the floor plate 16 on each side of the building, and the overlapping skins of the wall panels are secured together by fasteners such as screws or blind rivets. The wall panels for one end of the building are also erected and connected to each other and to the adjacent side wall panels 14 at the corners of the building. A set of opposing roof panels 12 are positioned in place, and the inner end portions of the roof panels 12 are rigidly connected by the top plate or ridge member 76 (FIG. 4) of a ridge beam 78. The connection is formed by a set of bolts 81 which are longitudinally spaced along the ridge spacer member 43 and extend through the ridge spacer member and lower roof skin 26 of each roof panel 12 in addition to the ridge beam plate 76. Some of the bolts 81 also extend through the longitudinal spacer members of each roof panel. Thus the bolts 81 and plate 76 form a rigid connection between each set of opposing roof panels 12 along the ridge 13 and provide for transmitting substantial tension forces between the roof panels across the ridge. The next pair of opposing roof panels 12 are assembled, and the skins of adjacent roof panels overlap as shown in FIG. 6. The overlapping ribs of the skins are secured together by fasteners such as screws and/or blind rivets.

The ridge beam 78 also includes downwardly projecting side walls 84 (FIG. 4) and outwardly projecting bottom flanges 86, and is constructed in longitudinal sections which are coupled together as the erection of the building progresses from one end of the building towards the opposite end. The side walls 84 of the ridge beam 78 are also coupled together at longitudinally spaced intervals by rectangular ridge beam spacers 88 which are also formed of sheet metal and are secured to the side walls by rivets. The ridge beam 78 is also connected to opposite end walls of the building, and after the building is erected and the bolts 81 are completely tightened, a bottom sheet metal ridge beam cover 92 is secured to the bottom flanges 86 and cooperates to complete the ridge beam 78 in the form of a box beam.

After all of the roof panels 12 are erected and coupled together by the top plate 76 of the ridge beam 78, and the outer end portions of the roof panels 12 are coupled to the side walls 14, as will be explained later, a tapered wedge member 96 (FIG. 4) is inserted between the upwardly projecting flanges 44 of the ridge spacer members 43 of the roof panels 12, and sections of the wedge member 96 extend continuously the full length of the building. After the wedge member 96 is positioned so that it forms a snug fit between the flanges 44, the wedge member 96 is drilled with holes which align with preformed holes within the flanges 44, and a series of bolts 98 are inserted through the holes to secure the wedge member in place. Thus the wedge member 96 functions to transfer compression forces between the upper or outer skins 22 of opposing sets of roof panels 12 across the ridge 13 and also functions to compensate for accumulated tolerance in the manufacture and assembly of the roof panels. A ridge cover plate 102 is placed over the wedge member 96 and is secured by screws to the outer skins 22 of the roof panels 12.

Referring to FIG. 5, the outer end portion of each roof panel 12 seats upon the upper header and spacer member 68 which connects the upper ends of the side walls panels 14 of each side wall. An inner attachment plate 105 slopes at an angle of approximately 45° between the inner skins of the roof panels 12 and wall panels 14, and the inner attachment plate 105 is formed in longitudinal sections in a manner similar to the ridge beam 78 and wedge member 96. V-shaped ribs 107 are formed along opposite edge portions of each attachment plate 105 for purpose of reinforcement, and the attachment plates may be ribbed or corrugated at longitudinally spaced intervals to provide additional compression strength.

The upper edge portion of each attachment plate 105 is rigidly secured to the roof panels 12 by a series of longitudinally spaced screws 110 each of which is threaded into a preassembled nut 112, preferably in the form of a "Rivnut" manufactured and marketed by The B. F. Goodrich Company. Each "Rivnut" extends through the inner skin 26 and a laterally extending spacer member 38 and secures these components together. Some of the "Rivnuts" also extend through the longitudinally extending spacer members 32 of the roof panels.

The lower edge portion of each inner attachment plate 105 is also rigidly connected to the side wall panels 14 by another set of screws 110. Each screw is threaded into an aligned "Rivnut" 112 which connects the overlapping portions of the longitudinally extending or vertical spacer members 58 and the uppermost laterally extending or horizontal spacer member 62 of each wall panel.

As also shown in FIG. 5, a laterally extending outer attachment plate 115 couples the outer end portions of the roof panels 12 to the upper end portions of the side wall panels 14, and is also formed in longitudinally continuous sections. The upper portion of each section of the outer attachment plate 115 is connected by bolts 116 to "Rivnuts" 112 secured to the overlapping portions of the eve spacer member 46 and end flanges of the longitudinal spacer members 32 of each roof panel 12. The lower portion of each section of the outer attachment plate 115 is secured by bolts 116 which are threaded into "Rivnuts" 112 secured to overlapping portions of the spacer members 58 and 68 of each wall panel 14 and to the outer skin 56.

From the drawings and the above description, it is apparent that a metal building constructed in accordance with the present invention, provides desirable features and advantages. For example, after the roof panels 12 and wall panels 14 are assembled as described above, the assembled panels have a combined total strength substantially higher than the strength of each panel per se times the number of panels. This higher total strength of the assembled panels results primarily from the transmission of a concentrated load in one panel or group of panels to the laterally adjacent and/or opposing panels through the longitudinally extending ridge beam 78 and attachment plates 105 and 115. Furthermore, the coupling of the roof panels 12 across the ridge 13 by means of the ridge member or plate 76 and the wedge member 96 along with the bolts 81 and 98, provides for utilizing the high tensile strength of the inner sheet metal roof skins 26 and the high compression strength of the outer roof skins 22 for carrying the loads. In addition, as mentioned above, the wedge member 96 compensates for accumulated tolerances in the manufacture and assembly of the roof panels 12.

Another important feature of a building constructed in accordance with the invention is provided by the coupling of the roof panels 12 to the wall panels 14 by means of the inner attachment plates 105 and the outer attachment plates 115. These attachment plates function to transfer the stress or loads from the roof panels to the wall panels and to utilize the inner and outer skins of the wall panels to resist bending of the roof panels. Thus the construction and assembly of the roof and wall panels effectively utilizes the inherent strength of the sheet metal skins of the panels and thereby eliminates the need for a frame and its cost of erection along with the need for roof purlins and wall girts.

Since the sheet metal used for forming the longitudinally and laterally extending spacer members within the roof panels 12 and wall panels 14 is of substantially lighter gages than are commonly used for forming roof purlins and wall girts for a conventional metal building of the same size, the total wieght of a building constructed in accordance with the invention is significantly lower than the total weight of a conventional metal building of the same size. As a result, the cost of metal used in constructing a building of the invention is significantly lower than the cost of the metal used in a conventional metal building. The relatively light weight of the roof panels 12 and wall panels 14, for example, less then 160 pounds for a building having a width of 36 feet, also provides for a simple and quick erection of the building without the need for a crane.

The prefabrication of the roof panels 12 and wall panels 14 also permits quick assembly of the panels, beginning at one end of the building and progressing towards the opposite end. The precise placement of the prepunched holes in the ridge and eave members also assures positive location of the panels and permits erection of the building by labor less skilled than the labor normally required for conventional metal buildings. It is also apparent that the roof and wall panels may enclose a thermal insulation material when desired.

While the form of building structure and its method of construction and assembly herein described constitutes a preferred embodiment of the invention, it is to be understood that the invention is not limited to this precise form, and that changes may be made therein without departing from the scope and spirit of the invention as defined in the appended claims.

The invention having thus been described, the following is claimed:

1. A frameless metal building comprising a plurality of generally rectangular roof panels and wall panels, each of said roof and wall panels including parallel spaced longitudinally extending sheet metal spacer members rigidly connected by laterally extending sheet metal spacer members, each of said roof and wall panels including inner and outer sheet metal skins rigidly secured to the corresponding said spacer members, said wall panels being secured together in adjacent relation to form parallel spaced opposite side walls and said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means including an outer ridge member extending along said ridge and rigidly connecting said outer skins of said roof panels on opposite sides of said ridge and effective to transfer compressive forces therebetween, and means for rigidly connecting said spacer members and said skins of said roof panels to said spacer members and skins of said wall panels for transferring loads from said roof panels through said wall panels to a base supporting said wall panels and for utilizing said wall panels to resist bending of said roof panels.

2. A metal building as defined in claim 1 wherein each of said roof panels includes a laterally extending ridge spacer member having an upper portion disposed adjacent the inner end of the corresponding said outer skin, and a tapered wedge member disposed between opposing said upper portions of said ridge spacer members of said roof panels on opposite sides of said ridge.

3. A metal building as defined in claim 1 wherein said outer ridge member comprises a tapered wedge member disposed between opposing inner ends of said outer skins of said roof panels, and means for securing said wedge member to said roof panels.

4. A metal building as defined in claim 3 and including a sheet metal ridge cover plate extending over said wedge member and secured to said roof panels.

5. A metal building as defined in claim 1 wherein said inner ridge member comprises a ridge plate extending along said ridge, and a series of fasteners securing said ridge plate to said spacer members and said inner skins of said roof panels.

6. A metal building as defined in claim 5 and including generally parallel spaced ridge beam sidewalls depending from said ridge plate and integrally connected therewith, and said ridge beam sidewalls have integral bottom flanges which cooperate to form an elongated hollow ridge beam effective to distribute a load on one roof panel to adjacent said roof panels and to facilitate erection and assembly of said roof panels.

7. A metal building as defined in claim 6 and including a bottom ridge beam cover plate rigidly secured to said bottom flanges of said ridge beam sidewalls and cooperating to strengthen said ridge beam.

8. A metal building as defined in claim 6 wherein said ridge beam includes a plurality of longitudinally spaced sheet metal spacer members connecting said ridge beam sidewalls and cooperating to strengthen said ridge beam.

9. A frameless building comprising a plurality of generally rectangular roof panels, each of said roof panels including parallel spaced longitudinally extending sheet metal spacer members rigidly connected by laterally extending sheet metal spacer members, each of said roof panels including inner and outer sheet metal skins rigidly secured to the corresponding said spacer members, means forming parallel spaced opposite side walls for said building, said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means extending along said ridge and rigidly connecting said outer skins of said roof panels on opposite sides of said ridge and effective to transfer compressive forces therebetween, and means for rigidly connecting said spacer members and said skins of said roof panels to said side walls for transferring loads from said roof panels through said side walls to a base supporting said side walls.

10. A building as defined in claim 9 wherein said inner ridge member comprises a ridge plate extending along said ridge, and a series of fasteners securing said ridge plate to said spacer members and said inner skins of said roof panels.

11. A building as defined in claim 9 wherein said means for rigidly connecting said spacer members and said skins of said roof panels to said side walls, comprise an inclined inner sheet metal attachment plate, and a series of fasteners rigidly connecting said inner attachment plate to said spacer members and said inner skins of said roof panels.

12. A building as defined in claim 9 wherein said means for rigidly connecting said spacer members and skins of said roof panels to said side walls comprise an outer sheet metal attachment plate extending horizontally along the outer end portions of said roof panels, and a series of fasteners rigidly connecting said outer attachment plate to said spacer members of said roof panels.

13. A building as defined in claim 9 wherein said outer skin of each said roof panel has parallel spaced longitudinally extending ribs formed from the sheet metal.

14. A building as defined in claim 9 wherein each said side wall comprises a series of wall panels, each said wall panel includes parallel spaced inner and outer sheet metal skins, and a plurality of longitudinally extending sheet metal spacer members rigidly connecting said inner and outer skins.

15. A building as defined in claim 14 wherein at least one of said skins for each said wall panel has parallel spaced ribs formed of the sheet metal, and said longitudinally extending spacer members of each said wall panel have flange portions projecting outwardly into said ribs.

16. A frameless metal building comprising a plurality of generally rectangular roof panels and wall panels, each of said roof and wall panels including parallel spaced longitudinally extending sheet metal spacer members rigidly connected by laterally extending sheet metal spacer members, each of said roof and wall panels including inner and outer sheet metal skins rigidly secured to the corresponding said spacer members, said wall panels being secured together in adjacent relation to form parallel spaced opposite side walls and said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means including an outer ridge member extending along said ridge and rigidly connecting said outer skins of said roof panels on opposite sides of said ridge and effective to transfer compressive forces therebetween means for rigidly connecting said spacer members and said skins of said roof panels to said spacer members and skins of said wall panels for transferring loads from said roof panels through said wall panels to a base supporting said wall panels and for utilizing said wall panels to resist bending of said roof panels, said latter means including an inclined inner sheet metal attachment plate, and a series of fasteners rigidly connecting said inner attachment plate to said longitudinally extending spacer members and said inner skins of said roof and wall panels.

17. A frameless metal building comprising a plurality of generally rectangular roof panels and wall panels, each of said roof and wall panels including parallel spaced longitudinally extending sheet metal spacer members rigidly connected by laterally extending sheet metal spacer members, each of said roof and wall panels including inner and outer sheet metal skins rigidly secured to the corresponding said spacer members, said wall panels being secured together in adjacent relation to form parallel spaced opposite side walls and said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means including an outer ridge member extending along said ridge and rigidly connecting said outer skins of said roof panels on opposite sides of said ridge and effective to transfer compressive forces therebetween, means for rigidly connecting said spacer members and said skins of said roof panels to said spacer members and skins of said wall panels for transferring loads from said roof panels through said wall panels to a base supporting said wall panels and for utilizing said wall panels to resist bending of said roof panels, said latter means including an outer sheet metal attachment plate extending horizontally along the outer end portions of said roof panels, and a series of fasteners rigidly connecting said outer attachment plate to said spacer members and outer skins of said roof and wall panels.

18. A frameless building comprising a plurality of generally rectangular roof panels, each of said roof panels including parallel spaced longitudinally extending sheet metal spacer members rigidly connected by laterally extending sheet metal spacer members, each of said roof panels including inner and outer sheet metal skins rigidly secured to the corresponding said spacer members, means forming parallel spaced opposite side walls for said building, said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means extending along said ridge and rigidly connecting said outer skins of said roof panels on opposite sides of said ridge and effective to transfer compressive forces therebetween, means for rigidly connecting said spacer members and said skins of said roof panels to said side walls for transferring loads from said roof panels through said side walls to a base supporting said side walls, each of said roof panels including a laterally extending ridge spacer member having an upper portion disposed adjacent the inner end of the corresponding said outer skin, and a tapered wedge member disposed between opposing said upper portions of said ridge spacer members of said roof panels on opposite sides of said ridge.

19. A building as defined in claim 18 wherein each said ridge spacer member has a generally Z-shaped cross-sectional configuration, and means for securing a lower portion of each said ridge spacer member to said inner skin of said roof panel.

20. A building as defined in claim 18 and including a sheet metal ridge cover plate extending over said wedge member and secured to said roof panels.

21. A frameless building comprising a plurality of generally rectangular roof panels, each of said roof panels including parallel spaced longitudinally extending sheet metal spacer members rigidly connected by laterally extending sheet metal spacer members, each of said roof panels including inner and outer sheet metal skins rigidly secured to the corresponding said spacer members, means forming parallel spaced opposite side walls for said building, said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means extending along said ridge and rigidly connecting said outer skins of said roof panels on opposite sides of said ridge and effective to transfer compressive forces therebetween, means for rigidly connecting said spacer members and said skins of said roof panels to said side walls for transferring loads from said roof panels through said side walls to a base supporting said side walls, said inner ridge member including a ridge plate extending along said ridge, a series of fasteners securing said ridge plate to said spacer members and said inner skins of said roof panels, generally parallel spaced ridge beam sidewalls extending from said ridge plate and integrally connected therewith, and said ridge beam sidewalls cooperate with said ridge plate to form an elongated hollow ridge beam effective to distribute a load on one roof panel to adjacent said roof panels and to facilitate erection and assembly of said roof panels.

22. A frameless building comprising a plurality of generally rectangular roof panels, each of said roof panels including parallel spaced longitudinally extending sheet metal spacer members rigidly connected by laterally extending sheet metal spacer members, each of said roof panels including inner and outer sheet metal skins rigidly secured to the corresponding said spacer members, means forming parallel spaced opposite side walls for said building, said roof panels being secured together in adjacent relation to form a roof extending from said opposite side walls to a ridge extending parallel between said side walls, means including an inner ridge member extending along said ridge and rigidly connecting said spacer members and said inner skins of said roof panels on opposite sides of said ridge and being effective to transfer tension forces therebetween, means extending along said ridge and rigidly connecting said outer skins of said roof panels on opposite sides of said ridge and effective to transfer compressive forces therebetween, means for rigidly connecting said spacer members and said skins of said roof panels to said side walls for transferring loads from said roof panels through said side walls to a base supporting said side walls, said outer skin of each said roof panel including parallel spaced longitudinally extending ribs formed from the sheet metal, and each said longitudinally extending spacer member of each said roof panel having an upper flange portion projecting upwardly into one of said ribs.

* * * * *